US006446364B1

(12) United States Patent
Herrero Codina

(10) Patent No.: US 6,446,364 B1
(45) Date of Patent: Sep. 10, 2002

(54) GRAB FOR EXCAVATORS OF FOUNDATION WALLS AND RECTANGULAR PILES, AND AN EXCAVATOR PROVIDED WITH SAID GRAB

(76) Inventor: Juan Vicente Herrero Codina, Ctra. C. 251 P.K. 5,5, 08440 Cardedeu (ES)

( * ) Notice: Subject to any disclaimer, the term of this patent is extended or adjusted under 35 U.S.C. 154(b) by 33 days.

(21) Appl. No.: 09/657,491

(22) Filed: Sep. 8, 2000

(30) Foreign Application Priority Data

Dec. 16, 1999 (ES) ..... 9902753

(51) Int. Cl.[7] ..... B66C 3/02
(52) U.S. Cl. ..... 37/187
(58) Field of Search ..... 37/461, 186, 187, 37/188; 294/68.23; 299/31; 175/408; 405/157, 272, 282, 283

(56) References Cited

U.S. PATENT DOCUMENTS

| | | | | | |
|---|---|---|---|---|---|
| 138,295 | A | * | 4/1873 | Symonds | 37/187 |
| 2,499,508 | A | * | 3/1950 | Karhu | 37/187 |
| 3,139,729 | A | * | 7/1964 | Miotti | 31/35 |
| 3,357,506 | A | * | 12/1967 | Bosredon | 175/99 |
| 3,443,648 | A | * | 5/1969 | Howard | 175/103 |
| 3,466,769 | A | * | 9/1969 | Novet | 37/103 |
| 3,829,992 | A | * | 8/1974 | Reid et al. | 37/103 |
| 4,314,615 | A | * | 2/1982 | Sodder, Jr. et al. | 175/94 |
| 4,882,859 | A | * | 11/1989 | Bollinger | 37/187 |
| 4,957,175 | A | * | 9/1990 | Lipsker et al. | 175/94 |
| 5,473,828 | A | * | 12/1995 | Kishi | 37/187 |
| 5,836,089 | A | * | 11/1998 | Lipsker | 37/186 |

FOREIGN PATENT DOCUMENTS

| | | | | |
|---|---|---|---|---|
| DE | 1533614 | | 1/1970 | |
| DE | 222913 | | 5/1985 | |
| DE | 4309269 | | 9/1994 | |
| EP | 649716 | | 4/1995 | |
| EP | 919669 | | 6/1999 | |
| FR | 1376253 | | 2/1965 | |
| JP | 402176090 | A * | 7/1990 | 175/266 |
| JP | 3110288 | | 5/1991 | |

* cited by examiner

*Primary Examiner*—Thomas B. Will
*Assistant Examiner*—Kristine Markovich
(74) *Attorney, Agent, or Firm*—Steinberg & Raskin, P.C.

(57) ABSTRACT

A grab having at least one shoe for support against the walls of the hole that the grab is digging, and elements for moving the shoes between a folded-in position in which they remain alongside the frame and an unfolded position in which they press against the walls of the hole. Preferably, unfolding of the shoes is performed automatically when the grab reaches the bottom of the hole. The excavator of the invention is provided with such a grab. A very high digging force is achieved without an increase in the volume or in the weight of the grab.

15 Claims, 4 Drawing Sheets

4
7
10
12
22
22
11
1
21
21
8
3
2

GRAB FOR EXCAVATORS OF FOUNDATION WALLS AND RECTANGULAR PILES, AND AN EXCAVATOR PROVIDED WITH SAID GRAB

The present invention relates to a grab for excavators of foundation walls and rectangular piles, which includes a frame and two substantially symmetrical jaws articulated onto the frame, which jaws can open and close with respect to each other.

BACKGROUND OF THE INVENTION

Several types of foundation wall excavators are known, being used for digging trenches for laying the foundations of walls and the like.

In particular, classic machines have a grab which includes a frame and two symmetrical jaws, articulated onto the frame, which can open and close with respect to each other thanks to two hydraulic cylinders. The grab unit is mounted on a vehicle and can either be suspended from a cable or mounted on the lower end of a support bar, usually square, which can slide vertically and is known as a "kelly".

The grab is made to descend open until it rests on the ground to be dug; it is then closed in such a way as to pick up the earth which is trapped between the two jaws and remove it from the site.

All these known machines share one common disadvantage: the force that the grab exerts on the site when it closes, that is, the extraction force, is relatively small, especially so in the case of grabs suspended from a cable, because that force is based exclusively on the weight of the grab.

In the case of grabs mounted on a kelly a greater force can be exercised than with suspended grabs, especially if the kelly is braked, because the reaction is transmitted to the vehicle; it nevertheless remains a relatively small force, and in some cases the reactions on the kelly even lift the vehicle, with the consequent danger involved.

Machines with a kelly can exert more force, but they have disadvantages when compared with cable machines, such as their greater cost and a limitation of the digging depth to the length of the kelly itself, which can be made up a limited number of telescopic sections.

In order to make greater digging force available for cable-suspended grabs, there has been a tendency in recent years towards increasingly heavy grabs. This solution nevertheless involves many disadvantages, such as the fact that the vehicle must also be heavier and more robust, with the consequent increase of cost and volume. Excavators that have achieved greater power based on weight are only manageable in open zones and cannot work in places where access is more restricted.

One recently proposed alternative to machines with grabs consists in an excavator with a milling head which reduces the rock to powder, and a water-pump extraction system. Such machines do satisfactorily resolve the problem of digging force on solid rock, but they have other disadvantages which restrict their use considerably: on the one hand, their they are much larger and more costly than machines with grabs, and, on the other hand, they are unsuited to most terrains, because any loose stones on the site are not broken up, they elude the milling mechanism and clog the extraction systems.

DESCRIPTION OF THE INVENTION

The objective of this invention is to solve the aforesaid disadvantages by developing a grab of the type mentioned in the introduction that is capable of exerting greater force against the terrain but can at the same time be lighter and of relatively low cost.

In accordance with this objective, the grab of the invention for foundation wall and rectangular pile excavators is characterised in that it includes at least two elements of support against the walls of the hole that the grab is digging and means for moving those supporting elements between a folded-in position in which they remain alongside the frame and an unfolded position in which they are pressed against the walls of the hole.

Thanks to the presence of these supporting means the grab can dig exerting much more force than if it relied solely on its own weight, and this advantage is achieved without significantly increasing either the volume or the weight of the machine or the grab. Additionally, the grab of the invention provides these advantages whether it is associated with a singe-section or telescopic kelly or is suspended from a cable.

Another advantage of the supporting means is that they help to keep the grab firmly in the hole, preventing it from deviating, due for example to any slight asymmetry between the jaws or to unevenness of the terrain.

Preferably, the means for moving the supporting elements between the folded-in position and the unfolded position actuate automatically when the grab reaches the bottom of the hole during the downward movement of the grab.

The supporting means thus come into action in synchronisation with operation of the grab, and it is not necessary to operate them manually each time the grab is lowered.

In accordance with the preferred embodiment of the invention, the grab includes at least one kelly section, to which the frame with the jaws is attached in such a way that it can move vertically between an upper stop and a lower stop, so that when the grab is not resting on the ground the frame is suspended from the kelly, and when the grab is resting on the ground the kelly rests on the frame.

This embodiment is mechanically simple, and allows the movement between the kelly and the frame to be used to drive the supporting means mechanically.

In this case, the means for moving the supporting means advantageously include a kinematic chain that links the kelly, the frame and the supporting elements, in such a way that when the jaws and the frame reach the bottom of the hole the kelly descends until it rests on the frame, and during this descending movement the kinematic chain causes travel of the supporting elements until they rest pressing against the walls of the hole.

This solution is robust and not very costly, and allows the automated operation mentioned above.

In one embodiment, said kinematic chain includes two arms, each articulated at one end to the kelly and at the other end to at least one link which is, in turn, articulated to the frame and to a supporting element. Each supporting element can include a long shoe with a vertical surface that comes into contact with the wall of the hole, while the kinematic chain can further include, for each shoe, an articulated parallelogram mounted between the frame and the shoe, so that the latter is kept substantially vertical during its displacement.

Preferably, the grab includes means for adjusting the maximum displacement between the kelly and the frame.

This characteristic allows the pressure of the supporting means against the walls of the hole to be adjusted to adapt it to the different types of terrain and different situations.

Also preferably, the grab includes means for locking the kelly and the frame to each other so that the mechanism can be overridden in situations in which it might prove to be a hindrance.

In one embodiment, the supporting elements have a smooth contact surface with the walls of the hole; alternatively, the supporting elements can have a contact surface with the walls of the hole which is provided with rubber projections or teeth. This last option is useful to give greater adherence against the walls or to cause milling of the hole wall, which can be desirable if, for example, one of the walls of the hole is concrete belonging to an adjacent section of the foundation wall.

In another aspect, the invention relates to an excavator for foundation walls and rectangular piles, characterised in that it is provided with a grab with the described features.

In one embodiment of the machine, the grab is mounted on one end of a kelly which can travel vertically on a corresponding support of the machine; the kelly can further be telescopic.

This embodiment has the usual advantages of the machines having a kelly, that is, greater control of the position of the grab and greater digging force, due to transmission of stresses to the machine, although in the case of the invention most of the force is borne by the supporting elements.

Alternatively, the grab can be mounted on the end of a kelly section which is in turn suspended from a cable attached to the machine. In this case, the machine still has all the advantages of the new grab of the invention in terms of digging force, and the perforation depth can be greater.

BRIEF DESCRIPTION OF THE DRAWINGS

For a better understanding of all that has been set out some drawings have been attached to show, schematically and solely by way of non-restrictive example, a practical case of embodiment.

In said drawings,

FIG. 1 is a side elevation view of the grab of the invention shown during its descent, with the side shoes folded in;

DESCRIPTION OF A PREFERRED EMBODIMENT

Figure 1:
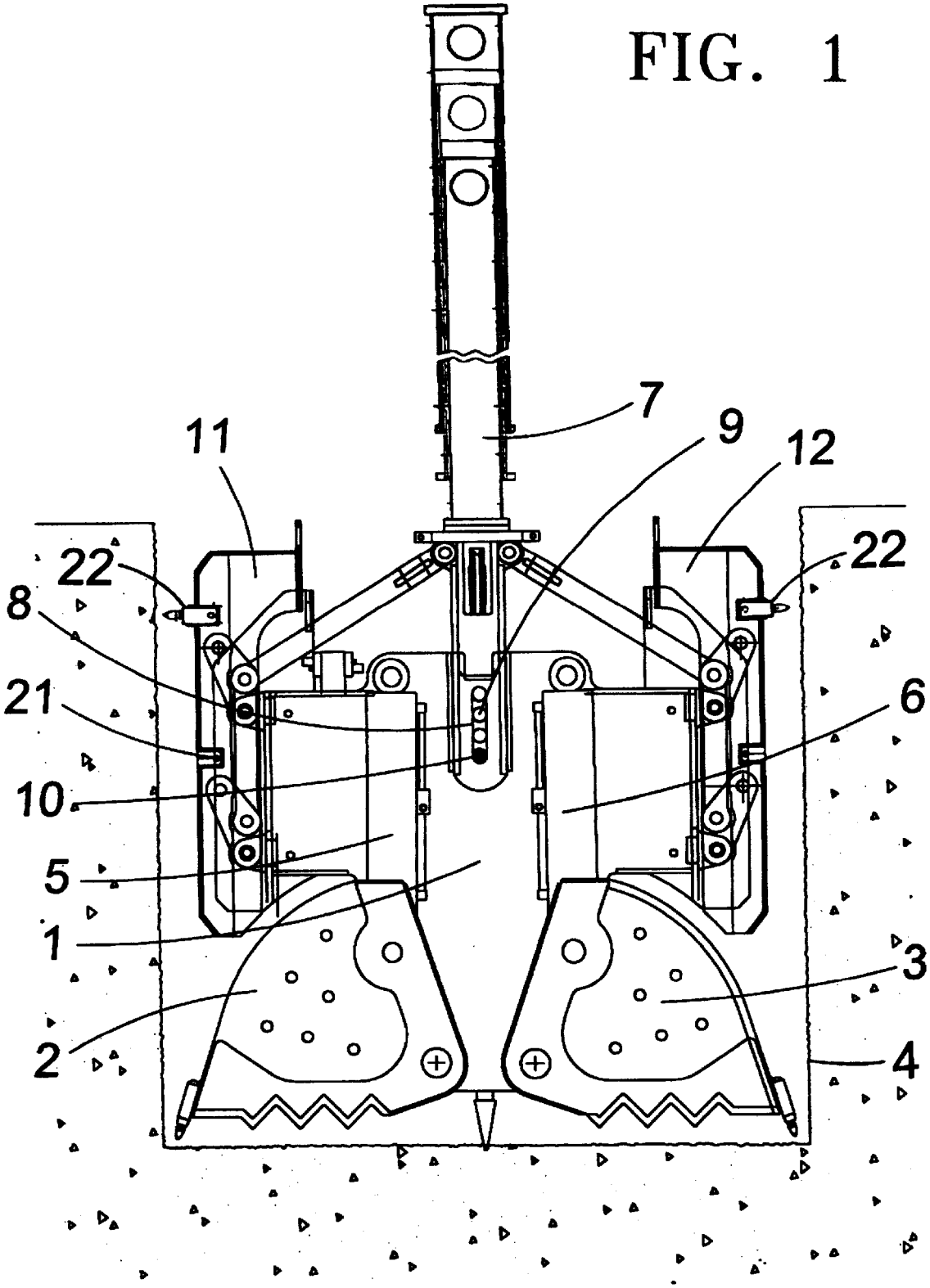
Figure 2:
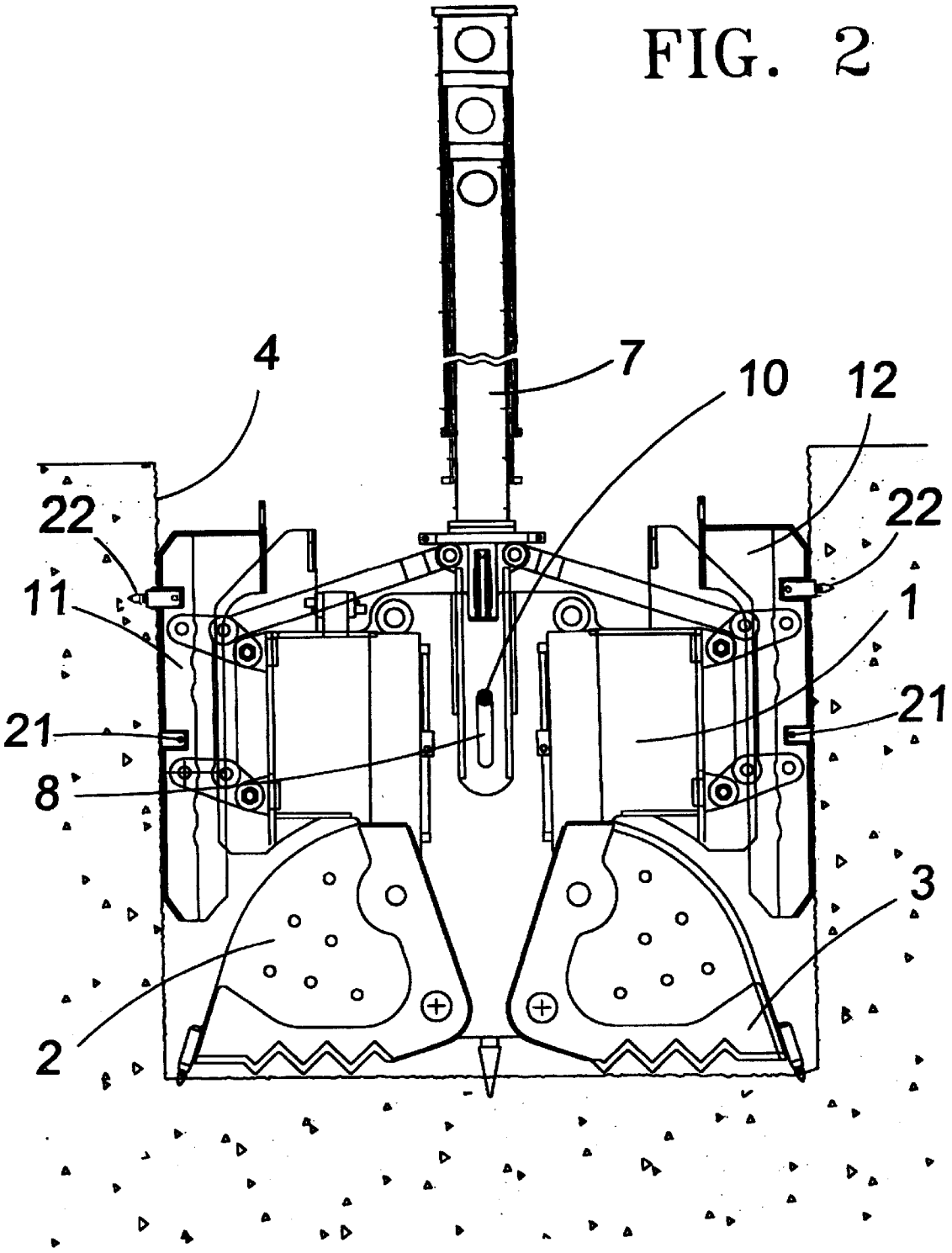
FIG. 2 is a view of the grab resting on the bottom of the hole to be dug out and with the side shoes in working position.
Figure 3:
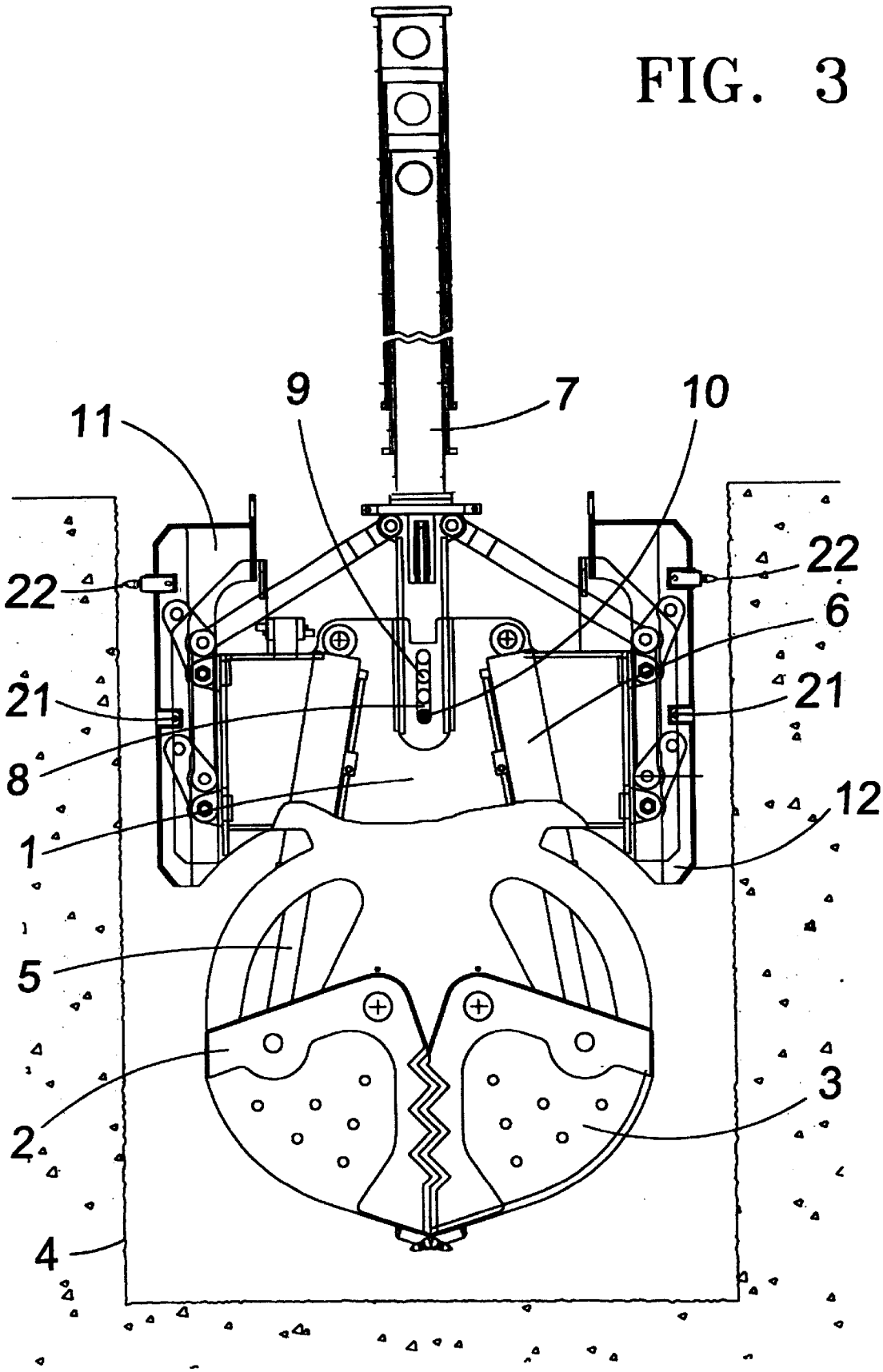
FIG. 3 is a view of the grab closed during subsequent lifting thereof to remove the earth.

FIGS. 1 to 3 show a grab for excavators for foundation walls, rectangular piles and similar digging work, which comprises a frame 1, onto which are articulated two jaws 2,3, also called "scoops", which constitute the digging parts as such.

FIGS. 1 and 2 show the grab open, as it descends towards the ground, while FIG. 3 shows the grab once it has closed and trapped a load of soil and is raised to remove the soil from the hole 4 which is being dug.

The jaws 2,3 open and close by means of two hydraulic cylinders 5,6 mounted on the frame, which are shown in extended position in FIG. 3.

In conventional grabs, the frame 1 is fixed to the end of a kelly which travels on a corresponding support on the machine, or else is suspended from a cable attached to the machine.

In the preferred embodiment of the grab of the invention, however, the frame 1 is coupled to a kelly section 7, in turn suspended from a cable, in such a way that there is scope for vertical travel between the frame and the kelly, between an upper stop and a lower stop.

For this purpose the kelly 7 has a slot hole 8, while the frame 1 includes a number of holes 9 aligned vertically and coinciding with the slot hole 8 of the kelly. A pin 10 is inserted into one of the holes 9, in such a way that when the grab is suspended from the cable (FIGS. 1 and 3) the frame 1 is suspended from the kelly through the pin 10 and displacement between the frame and the kelly is maximum, while when the grab is resting on the ground (FIG. 2) the kelly rests on the frame bearing on the same pin 10 and displacement between them is at its minimum.

The maximum displacement between the kelly and the frame can be varied by inserting the pin 10 in one or another of the holes 9, and the two parts can even be locked with respect to each other by inserting pins in the two end orifices 9.

The possibility of travel between the frame and the kelly is used to induce actuation of a mechanism that locks the frame against the walls of the hole 4, in such a way that the grab can exert greater force against the terrain.

The actuation of the mechanism that locks the frame against the walls of the hole will be described below with particular reference to FIGS. 4 and 5, in which the parts of the grab have been simplified in order to make it easier to understand the mechanism.

As can be appreciated from these figures, the grab of the invention has two side shoes 11 and 12, made up of elongate U-section pieces (see FIG. 3) whose web is the surface that will come into contact with the wall of the hole. The shoes 11 and 12 are attached both to the frame 1 and to the kelly 7 by means of an articulated mechanism or linkage that causes them to move between one position in which the shoe is folded against the frame (left part of FIGS. 4 and 5) and a position in which the shoe is unfolded and presses against the walls of the hole.

The linkage that joins the shoes 11,12 to the frame 1 and to the kelly 7 includes two pairs of bars 13,14 articulated at one end to the kelly 7 and at the other end to two pairs of links 15,16 which are likewise articulated to a shoe 11,12 and to the frame 1.

In order to reinforce the assembly and so that the movement of the shoes between one position and another is performed in a translational movement, the linkage includes two further pairs of links 17,18, each one of which is articulated onto the frame, to one of the shoes 11,12 and to the end of a bar 19,20 whose other end is articulated to the links 17,18 at the same point as the bars 13,14.

Figure 4:
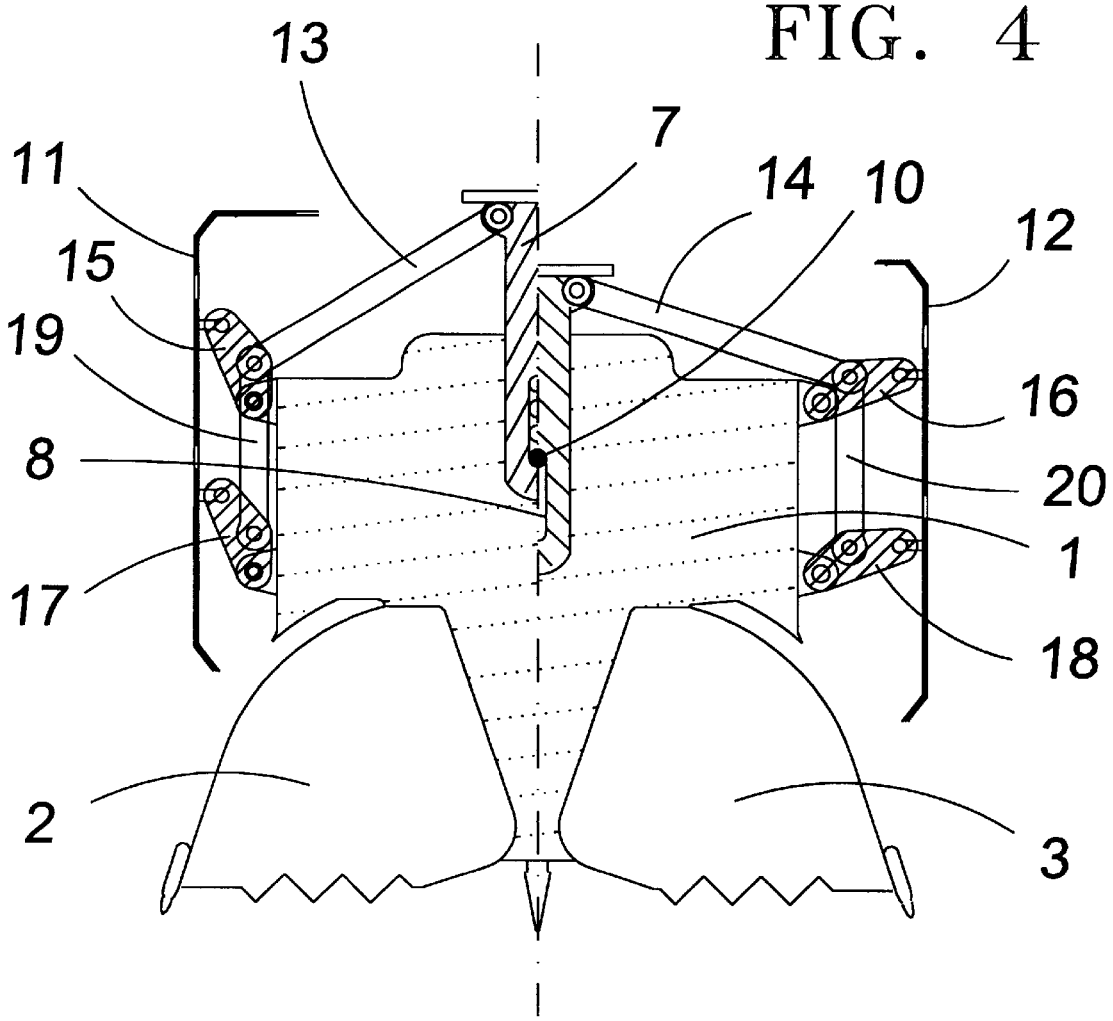
FIGS. 4 and 5 are schematic views of the grab in elevation and plan views, respectively, in which one of the side shoes of the grab has been shown folded in and the other shoe is shown unfolded.
Figure 5:
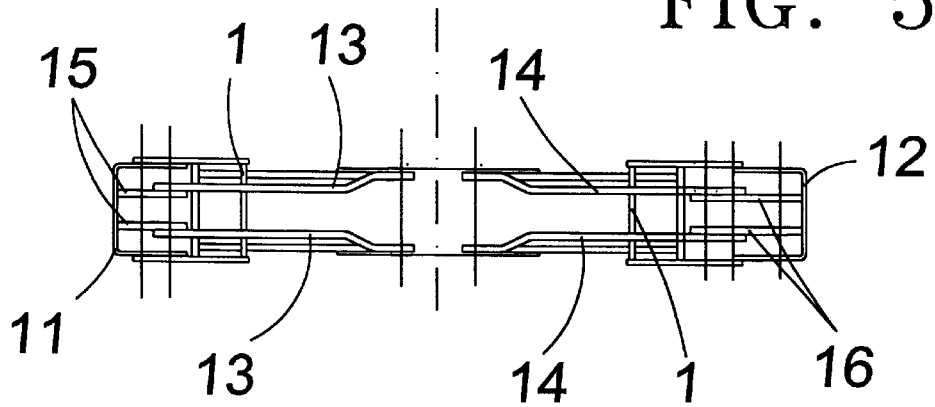

Comparison of the left and right parts of FIGS. 4 and 5 shows the different positions adopted by the shoes, the links and the bars of the linkage.

The folded position of the left part of the figure corresponds to the situation in which the grab is suspended, for example during lowering or raising (FIGS. 1 and 3, respectively), while the unfolded position of the right part of the figure corresponds to the situation in which the grab is resting on the ground (FIG. 2).

Reference will be made below to the various stages of operation of the grab, with reference to FIGS. 1 to 3.

During digging out of a hole 4 for a foundation wall or another similar type of foundations, the grab descends (FIG. 1) with the frame 1 suspended from the kelly 7 through the pin 10, that is, with the shoes 11,12 folded in against the frame. The jaws 2,3 are open.

When the frame 1 with the jaws 2,3 has come to rest on the bottom of the hole 4 (FIG. 2), the kelly 7 descends an additional length, while the pin 10 associated with the frame runs along the slot hole 8 of the kelly, until the latter rests on the frame bearing on the pin 10 itself. During this travel of the kelly with respect to the frame, the shoes 11,12 unfold thanks to the linkage until they rest pressing against the walls of the hole.

The hydraulic cylinders 5,6 are then activated to close the jaws 2,3 enclosing the soil at the bottom of the hole. Thanks to the presence of the shoes, the jaws can exert a much greater force on the terrain than conventional machines with grabs of the same weight, since the force of the shoes against the walls prevents the jaws from rising and "scratching" the soil as they close.

In this respect it should be stressed that although the pressure of the shoes against the walls of the hole is due only to the weight of the kelly and of the shoes, the reaction of the terrain on the jaws as they close tends precisely to press the shoes harder against the walls.

Once the jaws 2,3 have closed the grab rises again so as to remove the soil from the hole (FIG. 3); the pressure of the shoes against the walls ceases as soon as the cable or kelly is pulled upwards, since initially the frame does not move and it is only the kelly 7 which rises, with the shoes folding in at the same time, until the pin 10 fixed to the frame travels all the way along the slot hole 8 of the kelly. From this time the frame also rises, suspended from the pin 10.

During the first phases of digging out the hole, when the hole is not yet sufficiently deep to use the shoes, the shoe unfolding mechanism is locked as has been described, by using two pins 10. The locking can also be applied when digging in soft terrain, to prevent the pressure against the walls causing deviation of the grab.

The pressure that the shoes exert against the walls can be adjusted with a longer or shorter kelly travel with respect to the frame, that is, by inserting the pin 10 in one hole 9 rather than another.

In some cases the surface of the shoes 11, 12 which comes into contact with the walls of the hole can be fitted with rubber projections or teeth 22, which are housed in recesses 21 of the contact surface (see FIGS. 1, 2, 3). These rubber projections or teeth can be useful in some cases for milling the wall of the hole or for increasing the adherence of the shoe to the wall.

With this embodiment, it is not necessary to insert between two adjacent sections of a foundation wall a "locking key", i.e. a metal part that links one concrete section with the adjacent one (by a groove-and-tongue type joint) and that provides a smooth surface. While digging one section, the teeth of the grab of the invention scratch the concrete wall of the previous section of the foundation wall, leave it vertical and form grooves which will be filled with the concrete poured in the current section, such that a groove-and-tongue type joint is formed with no need for added parts.

This provides a remarkable simplification of the process, and makes it quite cheaper.

Despite the fact that one specific embodiment of the invention has been described and shown, it will be obvious to the skilled man that variants and modifications can be made, and that all the details may be replaced by others that are technically equivalent, without departing from the scope of protection defined by the attached claims.

In particular, although this specification refers to extension of the shoes under their own weight through a kinematic chain, it will be obvious that other methods of fitting and moving the shoes exist; for example, the shoes could be extended by means of hydraulic cylinders once the grab had reached the bottom of the hole, either automatically or under the control of the machine operator. In this case the presence of a kelly which can slide with respect to the frame would be unnecessary, since the shoes could be directly coupled to the frame of the grab through articulations and hydraulic cylinders.

What is claimed is:

1. A grab for excavators of foundation walls and rectangular piles, comprising:

a frame;

two substantially symmetrical jaws articulated onto the frame, said jaws open and close with respect to each other;

wherein said grab has at least two elements for support against the walls of a hole the grab is digging;

means for moving at least two supporting elements between a folded-in position in which at least two supporting elements remain alongside the frame and an unfolded position in which at least two supporting elements are pressed against the walls of the hole;

further comprising, at least one kelly section, attached to the frame with the jaws, said kelly section moves vertically between an upper stop and a lower stop, so that when the grab is not resting on the ground the frame is suspended from the kelly, and when the grab is resting on the ground the kelly rests on the frame;

wherein the means for moving the supporting elements include a kinematic chain that links the kelly, the frame and the supporting elements, said means for moving being structured and arranged so that when the jaws and the frame reach the bottom of the hole the kelly descends until it rests on the frame, and during this descending movement the kinematic chain causes travel of the supporting elements until the supporting elements rest pressing against the walls of the hole.

2. A grab as claimed in claim 1, wherein said means for moving the supporting elements between the folded-in position and the unfolded position actuate automatically when the grab reaches the bottom of the hole during the downward movement of the grab.

3. A grab as claimed in claim 1, wherein said kinematic chain comprises two arms, each said arm is articulated at one end onto the kelly and at an other end to at least one link, said at least one link being articulated to the frame and to a supporting element.

4. A grab as claimed in claim 3, wherein each supporting element comprises a long shoe with a vertical surface in contact with the wall of the hole, and wherein the kinematic chain further comprises, for each shoe, an articulated parallelogram mounted between the frame and the shoe, said shoe being substantially vertical during its displacement.

5. A grab as claimed in claim 1, further comprising means for adjusting the maximum displacement between the kelly and the frame.

6. A grab as claimed in claim 1, further comprising means for locking the kelly and the frame to each other.

7. A grab as claimed in claim 1, wherein the supporting elements have a smooth contact surface with the walls of the hole.

8. A grab as claimed in claim 1, wherein the supporting elements have a contact surface with the walls of the hole, said contact surface has rubber projections housed in recesses of the surface.

9. A grab as claimed in claim 8, wherein the rubber projections are teeth.

10. An excavator for foundation walls and rectangular piles, provided with a grab as claimed in claim 1.

11. An excavator as claimed in claim 1, wherein the grab is mounted on one end of a kelly which can travel vertically on a corresponding support of the machine.

12. An excavator as claimed in claim 1, wherein the grab is telescopic.

13. An excavator as claimed in claim 1, wherein the grab can be mounted at the end of a kelly section which is in turn suspended from a cable attached to the machine.

14. A grab for excavators of foundation walls and rectangular piles, comprising:

a frame;

two substantially symmetrical jaws articulated onto the frame, said jaws open and close with respect to each other;

wherein said grab has at least two elements for support against the walls of a hole the grab is digging;

means for moving at least two supporting elements between a folded-in position in which at least two supporting elements remain alongside the frame and an unfolded position in which at least two supporting elements are pressed against the walls of the hole;

further comprising, at least one kelly section, attached to the frame with the jaws, said kelly section moves vertically between an upper stop and a lower stop, so that when the grab is not resting on the ground the frame is suspended from the kelly, and when the grab is resting on the ground the kelly rests on the frame; and further comprising means for adjusting the maximum displacement between the kelly and the frame.

15. A grab for excavators of foundation walls and rectangular piles, comprising:

a frame;

two substantially symmetrical jaws articulated onto the frame, said jaws open and close with respect to each other;

wherein said grab has at least two elements for support against the walls of a hole the grab is digging;

means for moving at least two supporting elements between a folded-in position in which at least two supporting elements remain alongside the frame and an unfolded position in which at least two supporting elements are pressed against the walls of the hole;

further comprising, at least one kelly section, attached to the frame with the jaws, said kelly section moves vertically between an upper stop and a lower stop, so that when the grab is not resting on the ground the frame is suspended from the kelly, and when the grab is resting on the ground the kelly rests on the frame; and further comprising means for locking the kelly and the frame to each other.

* * * * *